United States Patent [19]

Vorie

[11] 4,155,091

[45] May 15, 1979

[54] COMPACT OMNIDIRECTIONAL ANTENNA ARRAY

[75] Inventor: Gilbert C. Vorie, Newark, N.Y.

[73] Assignee: IEC Electronics Corporation, Newark, N.Y.

[21] Appl. No.: 832,296

[22] Filed: Sep. 12, 1977

[51] Int. Cl.[2] ..... H01Q 21/00; H01Q 11/12; H01Q 7/00; H01Q 7/08

[52] U.S. Cl. ..... 343/728; 343/744; 343/748; 343/788

[58] Field of Search ..... 343/728, 744, 748, 787, 343/788

[56] References Cited

U.S. PATENT DOCUMENTS

| | | | |
|---|---|---|---|
| 3,139,619 | 6/1964 | Jones | 343/744 |
| 3,587,102 | 6/1971 | Czerwinski | 343/744 |
| 3,683,389 | 8/1972 | Hollis | 343/744 |

FOREIGN PATENT DOCUMENTS

| | | | |
|---|---|---|---|
| 972731 | 9/1959 | Fed. Rep. of Germany | 343/788 |

*Primary Examiner*—Alfred E. Smith
*Assistant Examiner*—Harry E. Barlow
*Attorney, Agent, or Firm*—Hoffman Stone

[57] ABSTRACT

An omnidirectional antenna array comprising a ferrite antenna inductively coupled to one leg of a loop antenna that lies in a plane parallel to the long axis of the ferrite antenna. The output signal may be taken from either of the antennas.

7 Claims, 12 Drawing Figures

COMPACT OMNIDIRECTIONAL ANTENNA ARRAY

BRIEF DESCRIPTION

This invention relates to a novel antenna array having omnidirectional characteristics and a gain considerably higher than either of the individual antennas composing it.

Briefly, an array according to the invention includes a ferrite antenna inductively coupled to one or more loop antennas. The loop, or each of the several loops, lies in plane parallel to the long axis of the ferrite antenna, and is positioned asymmetrically relative to it so that the inductive coupling is limited to one side only of the loop. The output of the array, taken from either of its components is approximtely omnidirectional.

The directional characteristics of the two antennas are both of the figure eight pattern, and in the arrangement of the invention, looking at a plane that includes the long axis of the ferrite antenna and is normal to the loop, the figure eight patterns are normal to each other. The electrical phase relationship between the two antennas is arranged to ensure that they reinforce each other so that, in effect, the patterns are added to produce a nearly circular, or so-called omnidirectional resultant pattern.

DETAILED DESCRIPTION

Representative embodiments of the invention will now be described in conjunction with the drawings, wherein.

The invention arose in connection with efforts to increase the sensitivity of a miniature, pocket sized paging receiver of the kind that frequently includes a built-in ferrite antenna, and will be described with receiver of that kind in mind. It is noted, however, that the invention is not so limited, but is expected to find use in many other applications such as, for example, receiving TV and FM radio signals, and in high frequency radio communications in general, the primary limitations being the characteristics of the ferrite antenna and the size required for the loop antenna.

Figure 1:
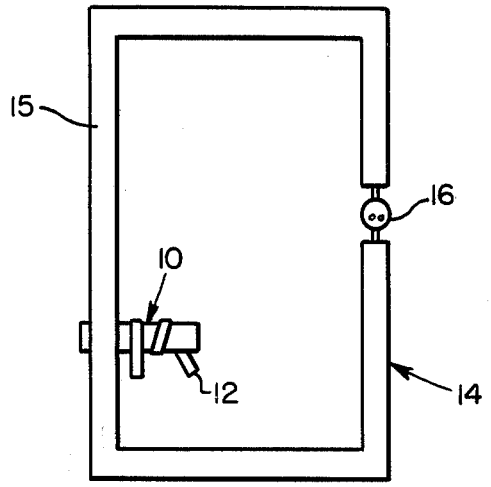
FIG. 1 is a front elevational view of an antenna array according to a first embodiment of the invention intended for use over a relatively narrow range of frequencies.

As shown, the antenna array according to the first embodiment of the invention illustrated in FIG. 1 includes a conventional ferrite antenna 10 having a pickup coil 12, and a loop antenna 14 coupled through one of its legs 15 to the ferrite antenna and mounted in a plane parallel to the long axis of the ferrite antenna. The ferrite antenna 10 may be one that is conventionally furnished by the manufacturer of the receiver and built into the case that houses the receiver itself. One leg 15 of the loop antenna is coupled to the ferrite antenna, and for this purpose the loop antenna 14 is mounted fairly close to the ferrite antenna, preferably within one eighth inch or less in the case of a receiver intended for use at about 150 megaHertz. The loop 14 may be secured on the outside of the receiver housing, if desired, in those cases where the built-in ferrite antenna 10 is mounted close to an outer wall of the housing. This latter is the preferred arrangment when the loop antenna 14 is used as an attachment to improve the sensitivity of a receiver already equipped with a built-in ferrite antenna.

Figure 2A:
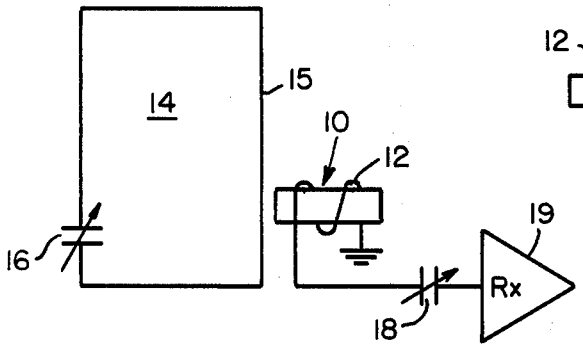
FIG. 2A is a schematic diagram of the array shown in FIG. 1 connected to the input of a radio receiver, the signal being taken from the ferrite anntenna portion of the array.

As shown in FIG. 2A the output signal of the array may be taken from the pickup coil 12, in which case the ferrite antenna is tuned by adjusting the coupling capacitor 18 connected between the pickup coil 12 and the receiver 19. The loop antenna 14 is tuned to the same frequency as the ferrite antenna by adjusting a capacitor 16 connected between the otherwise open ends of the loop.

Figure 2B:
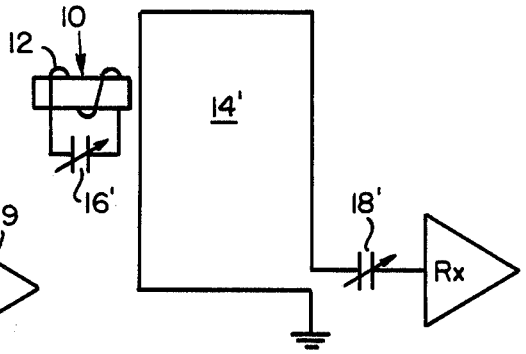
FIG. 2B is a schematic diagram of the array shown in FIG. 1 connected to the input of a radio receiver, the signal being taken from the loop antenna portion of the array.

In the alternative arrangement shown in FIG. 2B, the signal is taken from the loop antenna 14', which is tuned by adjusting the coupling capacitor 18', and a separate turning capacitor 16' is connected across the pickup coil 12 for tuning the ferrite antenna. In both cases the gains of the two antennas 10 and 14 are approximately equal.

In an actual embodiment designed for operation at frequencies between 150 and 160 megaHertz the core of the ferrite anntenna 10 was a bar of ferrite material, made by the Indiana General Corporation and commercially designated Q-3, about one and one quarter inch long, one quarter inch wide, and about one eighth inch thick. The pickup coil 12 consisted of two turns of 0.980 fine silver ribbon 3/16 inch wide and 0.017 inch thick. The loop antenna 14 was formed as a single rectangle $2\frac{1}{8}$ inches by $3\frac{1}{2}$ inches of the same silver ribbon material. The tuning capacitor 16 was variable fro 1.8 pfd. to 18 pfd.

Figure 3:
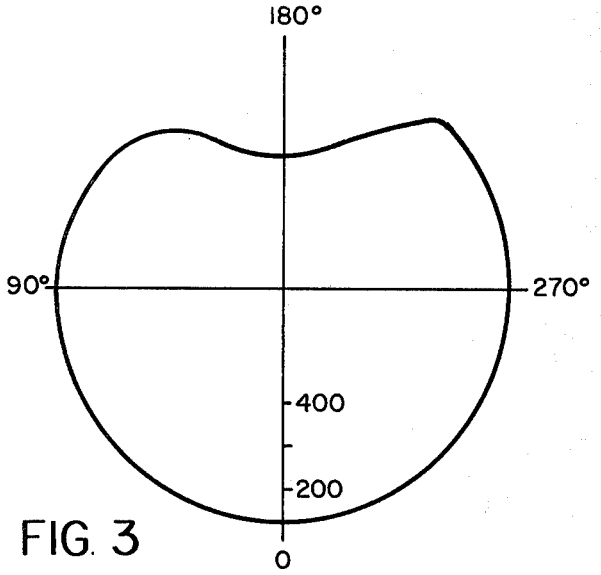
FIG. 3 is a chart on polar coordinates showing the measured directional characteristics of the array shown in FIG. 1 with the loop antenna portion in a vertical position and upright as shown.
Figure 4:
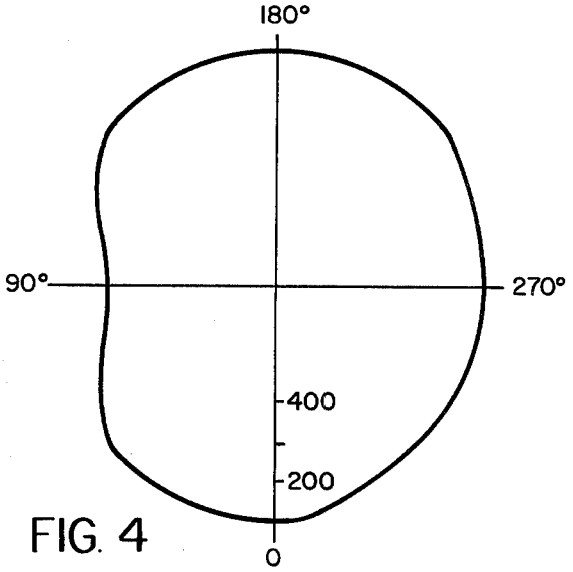
FIG. 4 is a chart similar to the chart of FIG. 3 but showing the characteristic with the array positioned with the loop antenna horizontal.
Figure 5:
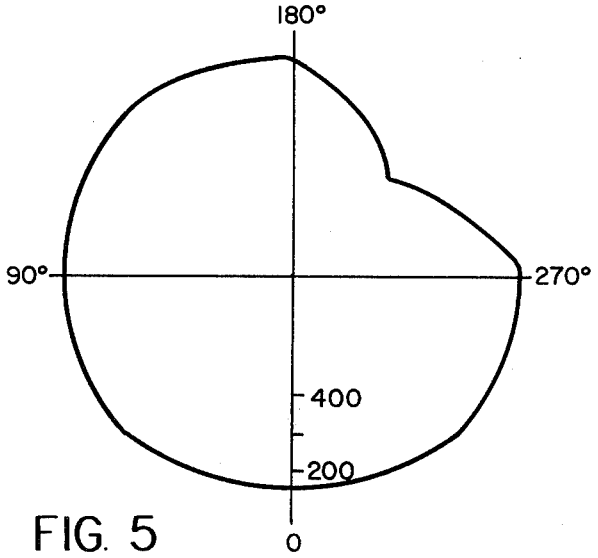
FIG. 5 is a chart similar to those of FIG. 3 and 4 but showing the characteristic with the array positioned with the loop antenna vertical but normal to the position shown in FIG. 1.

The array was connected to the input of a conventional paging receiver (not shown in detail) and its performance measured on a test range in terms of the power output of a transmitter spaced from it required to trigger the receiver. The results are shown in FIGS. 3, 4, and 5. The curve shown in FIG. 3 was taken with the receiver positioned with the two long legs of the loop antenna 14 vertical. It is noted that the pattern is as nearly omnidirectional as can reasonably be expected in view of shielding effects pf the receiver itself and the usual difficulties of measuring antenna performance. The curve of FIG. 4 was taken with the receiver positioned to keep the loop antenna 14 always horizontal, and the curve of FIG. 5 was taken with the receiver positioned on its side, the short leg of the loop antenna 14 being vertical. The incoming signal was transmitted along a horizontal path and polarized with its E field vertical.

The combination of the three curves provides a rough idea of the three dimensional sensitivity characteristic of the array.

Figure 6:
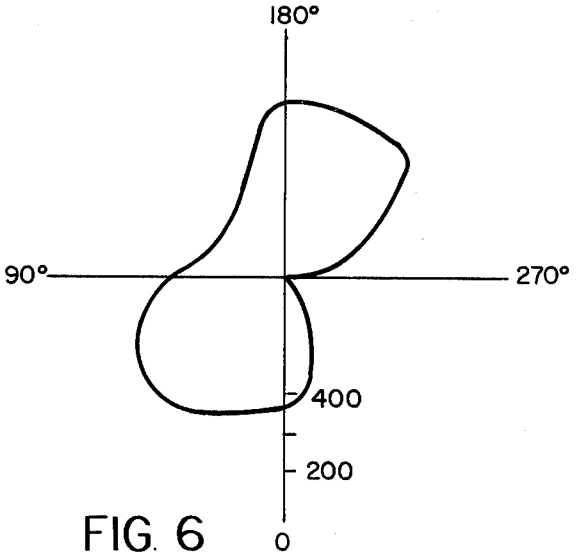
FIG. 6 is a chart similar to those of FIGS. 3–5 showing the measured characteristic of the ferrite antenna taken along, without the loop antenna.

The curve of FIG. 6, which is plotted on the same scale as the curves of FIGS. 3, 4, and 5, shows the measured pattern for the ferrite antenna 10 along, after the loop antenna 14 was removed from the receiver, and with the ferrite antenna positioned with its long axis horizontal. A comparison of FIGS. 3 and 6 clearly shows the improvement achieved the invention. Adding the loop antenna 14 to the conventional ferrite antenna 10 achieves a substantial increase in gain and a very marked improvement in directional characteristics at very little increase in size.

Figure 7:
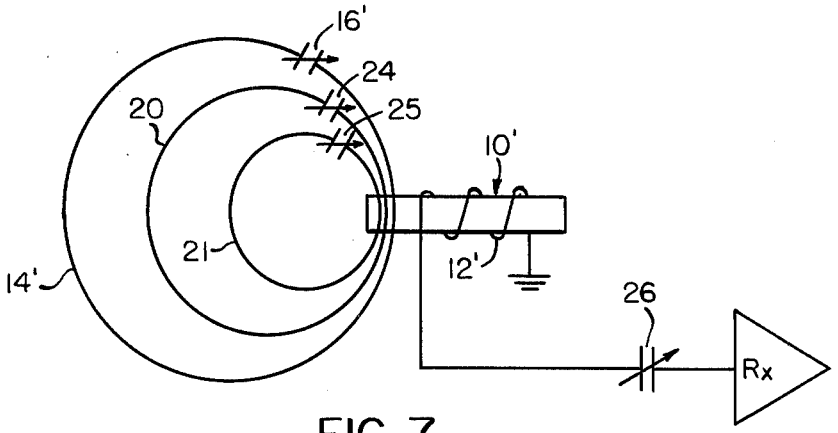
FIG. 7 is a schematic diagram of an arrangement for making the gain of the array remain relatively high and omnidirectional over a relatively broad range of frequencies.

The embodiment shown in FIGS. 1 and 2 is limited in respect of the range of frequencies to which it can be satisfactorily tune. For relatively broad band performance the array may be modifed as shown in FIG. 7 by adding additional loops 20 and 21, each with its own tuning capacitor 24 and 25, respectively. The ferrite antenna 10′ may be turned by adjusting the coupling capacitor 26 connected between the pickup coil 12′ and the input to the receiver to a frequency approximately in the middle of the range covered by the three loop antennas 14′, 20, and 21. And, depending upon the degree of gain desired, any desired number of loop antennas may be coupled inductively to the ferrite antenna, each of the loop antennas being tuned to a separate frequency.

Figure 8:
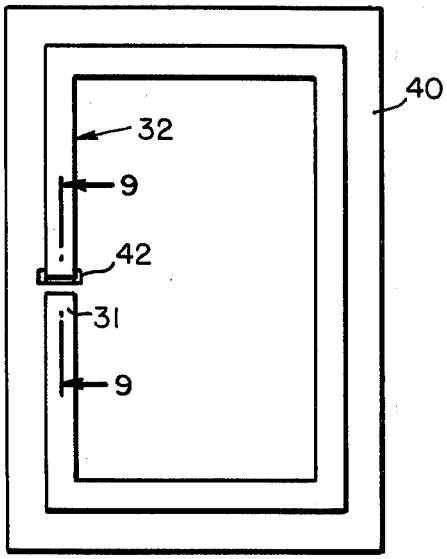
FIG. 8 is a front elevational view of a tunable loop antenna according to the invention including a self-contained capacitive tuning arrangement.
Figure 9:
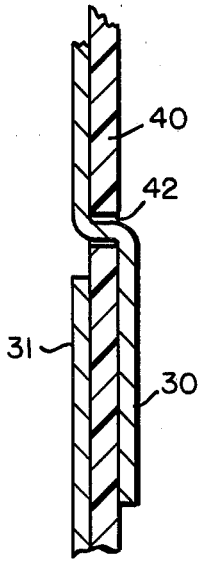
FIG. 9 is a fragmentry longitudinal sectional view taken along the line 9—9 of FIG. 8.
Figure 10:
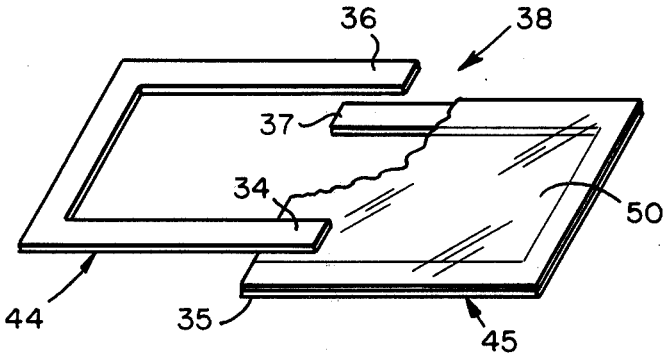
FIG. 10 is an isometric view, in exploded form and with supporting parts omitted, of a tunable loop antenna according to a modified form of the invention.
Figure 11:
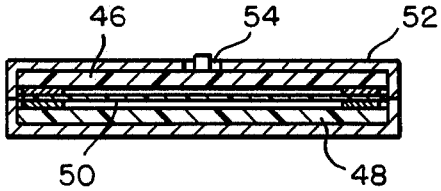
FIG. 11 is a cross sectional view of a looped antenna of the kind shown in FIG. 10, including the supporting parts.

According to an additional feature of the invention, the capacitor 16 that tunes the loop entenna 14 need not be a separate component, but may be consitituted by overlapping end portions 30 and 31 of the loop 32 shown in FIGS. 8 and 9, for example or the end portions 34 and 35, and 36 and 37 of the loop 38 shown in FIGS. 10 and 11.

The tuning capacitor illustrated in FIGS. 8 and 9 in the usual case will be fixed in value. The loop 32 may be formed by cementing a ribbon conductor on a dielectric support 40, extending one end portion 30 through a slot 42 in the support and cementing it on opposite side of the support from the second end portion 31, which ends just short of the slot 42. The length of the overlap is selected to provide the capacitance required to tune the loop to the desired frequency.

The arrangement may readily be made variable as shown in the embodiment of FIGS. 10 and 11, which includes two U shaped portions 44 and 45, each cemented on a separate dielectric support 46 and 48, respectively. The U's 44 and 45 are placed in confronting, bight-to-bight position and separated by a sheet of a dielectric material 50, which may be cemented to either one of them, and with end portions of their legs overlapping. The assembly is enclosed in a housing 52 which is provided with an access slot 54 for moving one of the supports relative to the other to vary the degree of overlap to tune the loop to any desired frequency within a predetermined range.

What is claimed is:

1. An antenna array comprising an elongated ferrite antenna, a loop antenna, and means for mounting said antennas in closely spaced array asymmetrically relative to each other with the ferrite antenna crossing the loop at only a single location along it so that said loop antenna is inductively coupled to said ferrite antenna.

2. An antenna array according to claim 1 wherein the gain of said loop antenna is approximately equal to the gain of said ferrite antenna.

3. An antenna array comprising an elongated ferrite antenna, a plurality of loop antennas, and means for mounting said loop antennas close to said ferrite antenna and asymmetically relative thereto with the core of the ferrite antenna crossing the loop antenna at only a single location along each of the loop antennas so that each of said loop antennas is inductively coupled to said ferrite antenna.

4. An antenna array according to claim 3 including also tuning capacitors for tuning said ferrite antenna and each one of said loop antennas, the values of said tuning capacitors being selected to tune each of said loop antennas to a different frequency in a selected range of frequencies and to tune said ferrite antenna to a frequency within the selected range.

5. An antenna array comprising an elongated ferrite antenna and a loop antenna, means for mounting said antennas relative to each other with the ferrite antenna crossing the loop at only a single location along it so that there is inductive coupling between them, and means for taking an electrical output signal from one of said antennas.

6. An antenna array according to claim 5 including tuning means for tuning both of said antennas to resonate at a preselected frequency.

7. An antenna array according to claim 5 wherein said ferrite antenna lies in a plane parallel and relatively close to the plane of the loop.

* * * * *